United States Patent [19]

Lerch

[11] Patent Number: 4,964,586

[45] Date of Patent: Oct. 23, 1990

[54] RELEASABLE HOLDING DEVICE FOR CORES

[75] Inventor: Rolf Lerch, Darmstadt-Eberstadt, Fed. Rep. of Germany

[73] Assignee: Maschinenfabrik Goebel GmbH, Darmstadt, Fed. Rep. of Germany

[21] Appl. No.: 431,160

[22] Filed: Nov. 3, 1989

[30] Foreign Application Priority Data

Nov. 5, 1988 [DE] Fed. Rep. of Germany ..... 3837611

[51] Int. Cl.[5] ..... B65H 75/24; B23Q 3/14; B23B 5/22

[52] U.S. Cl. ..... 242/72 R; 269/48.1; 279/2 R

[58] Field of Search ..... 242/72 R, 68.1, 68.2, 242/72 B, 72.1; 279/2 R; 269/48.1

[56] References Cited

U.S. PATENT DOCUMENTS 3,667,696 6/1972 McCarthy ..... 242/72 R
3,792,868 2/1974 Flagg ..... 279/2 R
3,993,317 11/1976 Flagg ..... 242/68.2 X
4,193,633 3/1980 Potter ..... 279/2 R
4,374,575 2/1983 Lerch et al. ..... 242/56.5
4,516,786 5/1985 Lund ..... 279/2 R

FOREIGN PATENT DOCUMENTS 3700472 7/1988 Fed. Rep. of Germany .

*Primary Examiner*—John M. Jillions
*Assistant Examiner*—John P. Darling
*Attorney, Agent, or Firm*—Watson, Cole, Grindle & Watson

[57] ABSTRACT

A device for releasably holding a core or the like relative to a drive shaft passing therethrough includes at least two clamping elements located within the core. Guide pieces are fixed to a ring disc which surrounds a ring connected to the drive shaft. These guide pieces allow the clamping elements to move radially relative to the drive shaft and hold the core. A friction brake is provided to brake the ring relative to the ring disc. Also, a locking pawl arrangement is provided to selectively prevent the ring disc from rotating with the drive shaft. Accordingly, back slipping is prevented which undesirably loosens the core from the clamping elements.

13 Claims, 2 Drawing Sheets

1
3
4
2
19
1
27
28
26
25
10
I
I
5
17
6
18
16
9
15
20
21
22
14
13
23
24
8
11
7
12

RELEASABLE HOLDING DEVICE FOR CORES

BACKGROUND OF THE INVENTION

1. Technical Field of the Invention

The present invention relates generally to the releasable holding of cores and reels of paper, film, plastic, metals, fabrics or the like and more particularly to a holding device with at least two clamping segments, each of which can be fixed and changed in its radial position and moved on at least one profile.

2. Discussion of the Related Art

Holding devices are used to support sleeves in machines that process webs in such a manner that webs of paper film, metals, plastics, fabrics or the like that are wound on these sleeves, cores or the like can be unwound from these sleeves in order to be fed to a processing machine. The holding devices can also be used to rotatably support the cores or sleeves on which the webs coming from a processing machine can be wound.

During a processing operation, i.e., the winding or unwinding process, the reels located in the processing machine must be rotatably held as precisely centered as possible. However, at the end of each processing operation, it is necessary to remove the cores, sleeves or the like from the machine or even remove the reels of web-like material that is wound on them. Accordingly, it is required to release the cores from the holding devices carrying them. To accomplish this, one frequently resorts to so-called expansion clamping shafts or expansion clamping heads in which some components can be moved in such a manner, e.g., in the radial direction of the entire device, so that the cores can be either clamped or released from their interior and can be removed from the processing machine. The elements of the "clamping heads" that ca be moved in the radial direction for the purpose of fixing or releasing are often moved along tilted, thus requiring essentially wedge-shaped paths in order to be moved in this manner into either the clamping position or into the releasing position.

For example, a device for the releasable holding of cores is shown in U.S. Pat. No. 3,667,696. This device has several eccentrics arranged in such a manner that during a relative rotation between the essentially internal device and the clamping elements cause the clamping elements to be moved radially when the eccentric assigned to the respective clamping element is rotated. In addition, this device comprises at least two radially movable clamping segments or clamping elements which are mounted in such a manner on their carrier that they can be clamped into an extreme position. However, the sleeves, cores or the like that are held rotatably therein are often exposed to alternating forces. These forces can release the clamping of this device so that the clamping segments of the device move radially in an undesired manner, thereby undesirably loosening the clamped cores. In an attempt to prevent this problem, the end discs coupled with actuating ring device can be secured against turning by locking screws. However, this solution is complicated to manipulate and is therefore contrary to automatization of the clamping process.

Accordingly, it is an object of the present invention to prevent undesired loosening of the core clamping during automatic operation.

It is a further object of the present invention to prevent such loosening while achieving efficient clamping and releasing of the cores.

Other objects and advantages are apparent from the specification and drawings which follow.

SUMMARY OF THE INVENTION

The foregoing and additional objects are achieved by a brake counteracting a displacement of each clamping segment and acting in each radial position of the clamping segment; a movable pawl mounted stationary on the machine frame in the immediate vicinity of the clamping segment, a pin, a ratchet or the like; and an accommodating device corresponding to the pin, the ratchet, pawl or the like and adjacent on the outside of the holding device. In addition to this, it is proposed that the pin can be released, as the occasion demands, to which end at least one electromagnet, pressure medium cylinder or the like can be used per pin.

The brake that is used can be a friction brake with at least one friction lining and may be a multiple-plate brake with the friction linings being arranged concentric to the drive shaft.

In this manner a clamping device designed in a simple, sturdy and cost-effective manner is provided with which cores, sleeves, reels or the like can be adequately held automatically even if during operation only small pulling forces on the part of the web to be wound or unwound or even such forces that in the final analysis could lead to a undesired releasing of the clamping element were to act on the reel or its holding device. Such forces could, for example, come about by a change in the clamping to which the web-like material is subjected at the beginning or end of an acceleration process or also at the so-called emergency stop with an especially vigorous braking. In addition to this, the dimensions of the invention permit a compact construction.

The proposed device is explained in detail with reference to an embodiment which does not restrict the inventive thought and which is shown as a schematic in the attached drawings. In the present connection, non-important details that are sufficiently known in the art are not illustrated in the drawings for the sake of a straight-forward presentation. Therefore, only those parts which are required to explain in detail the proposed device ar shown in the figures. Individual features of the embodiment can be employed singularly or together in any arbitrary combination to form other embodiments of the invention.

DETAILED DESCRIPTION OF THE PREFERRED EMBODIMENTS

Figure 1:
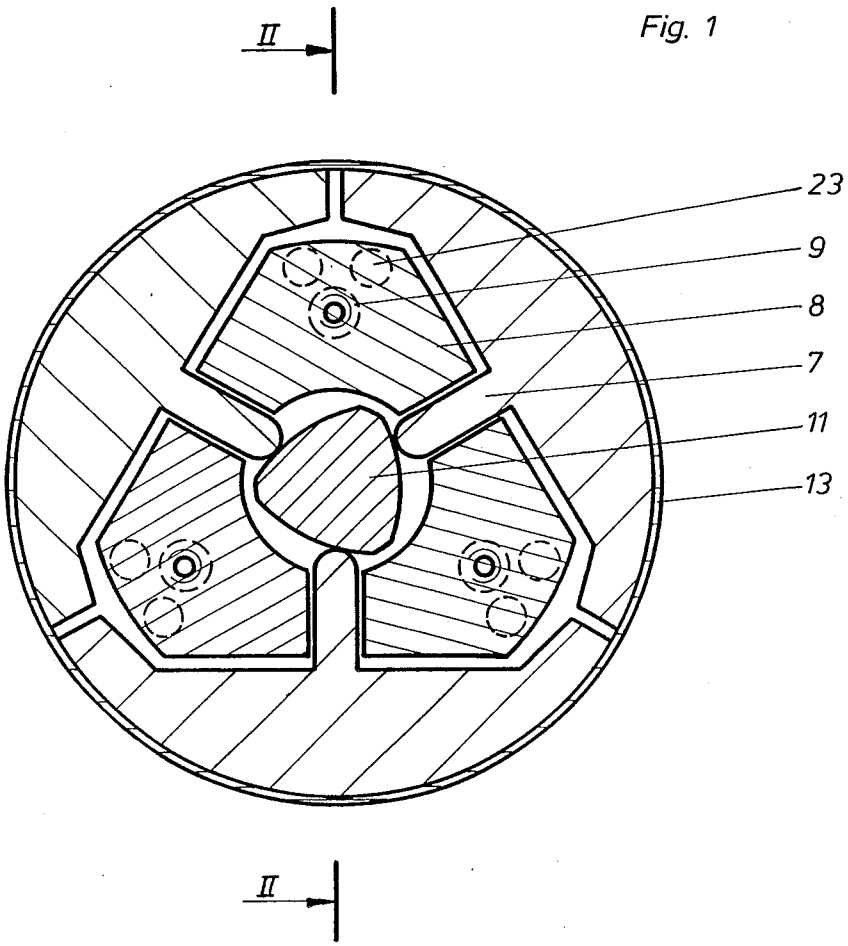
FIG. 1 is a sectional view of the holding device of the present invention.

The present invention will now be described in more detail with reference to the attached drawings. A drive shaft 2 is held by bearings 3 and 4 so as to rotate in a known housing section 1 and serves as a pivot arm for holding wound cores 13, reels or other suitable mechanisms for holding. At the end of the shaft 2 there is a rotating part 5 which can comprise the same component as the shaft 2. A flange 6 is connected to the rotating part 5. Therefore, the proposed device may be analogous to the commonly owned device disclosed in West German Patent No. 37 00 472.7, the specification of which is hereby incorporated by reference.

Figure 2:
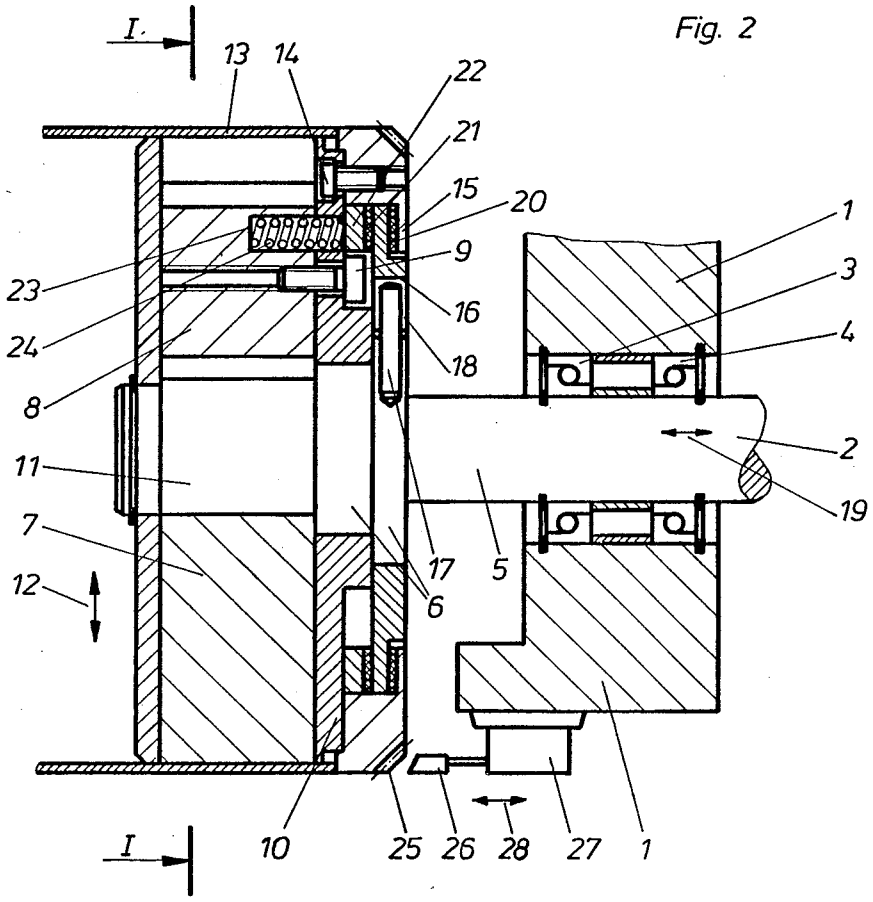
FIG. 2 is a sectional view taken along line II/II of FIG. 1.

The rotating part 5 obviously rotates together with the shaft 2 and may have a circular cross-section or any other arbitrary, suitable cross-section, e.g., a so-called multiple wedge profile. Clamping segments or elements 7 are provided which can be radially adjusted upward or downward as shown in FIG. 2 and are attached radially at the one end of the rotating part 5, e.g., the left end as shown in FIG. 2.

In addition to this, guide pieces 8 are provided to guide the clamping segments or parts of the clamping segments 7 in both the radial and circumferential direction. The guide pieces 8 are secured against rotation by screws 9 or the like on an annular disc 10, which in turn is secured on the flange 6 so that it can be turned relative to the flange. In this manner it is possible to move the clamping segments 7 radially, i.e., in the direction of the arrow 12 by rotating the shaft 2 and correspondingly rotating profile piece(s) 11 fixedly connected to the shaft 2 at non-rotating guide pieces 8. In this manner, the respective core 13, sleeve, wound reel or the like can be gripped and held from the inside by means of the clamping segments 7. In addition to this, it is possible with the aid of known withdrawal devices (not illustrated) to move the clamping segments 7 in the direction of the arrow 12 towards the interior of the device in order to release the cores, if so desired.

The disc 10 is connected with the aid of screws 14 to a ring disc 15. Between the disc 10 and the ring disc 15 is another ring 16 in a corresponding recess inserted, for example, into the ring disc 15. Ring 16 is fixedly connected to the shaft 2 so as to rotate therewith. This connection can be made, for example, by admitting a pin 17 in the shaft 2 so as to extend radially and fastening pin 17 to the shaft, the shaft engaging in a corresponding recess 18 located on the ring 16. In this manner a simple coupling is produced that permits the ring 16 to rotate with the shaft; on the other hand, the ring can be moved within limits relative to the shaft 2 in the axial direction, i.e., in the direction of the arrow 19.

A coupling lining 20 is inserted between the ring 16 and the ring disc 15. A coupling ring 21 and a pressure disc 22 are inserted between the ring 16 and the disc 10. The dimensions of the coupling lining 20 and the coupling ring 21 as well as their composition may be identical.

Bores 23 in which compression springs 24 are located are machined into the guide pieces 8 in the axial direction of shaft 2, i.e., parallel to the direction of the arrow 19. Each compression spring 24 forces through the intermediary of the pressure disc 22 the coupling ring 21 against the ring 16, and bears on the ring disc 15 via the coupling lining 20. In this manner a brake is produced, preferably a multiple-plate brake with friction linings, comprising the coupling lining 20 and the coupling ring 21, that is concentric to the drive shaft 2 and counteracts a relative movement of the shaft 2 and the clamping segments 7. The braking induced thereby occurs not only at a specific radial position of the clamping segments 7 or a clamping segment 7 but rather at any arbitrary radial point of the clamping segments 7. Whenever the radial position of the clamping segments 7, i.e., the relative position between the shaft 2 and the clamping segments 7 is to be changed, the brake, comprising the coupling linings and their related parts, and the braking forces induced by the compression springs are overcome. Thus, these brake forces can be chosen or adjusted in such a manner when assembling the device that the clamping segments 7 cannot slip in an undesired manner radially inward due to the vibrations, accelerations or delay forces in the machine. In this manner the core 13, wound reel or the like is prevented from becoming loose in an undesired manner while operating the device.

On the outside of the ring disc 15, in particular on its outer diameter since the outer contour of this ring disc is generally circular, a tooth system 25 is machined, preferably tilted, into the ring disc 15. A similarly toothed ratchet or pawl 26 can mesh with this tooth system when the pawl 26 is moved in the direction of the arrow 28 by means of an electromagnet 27 or a pressure medium cylinder. When the pawl 26 in FIG. 2 is moved to the left, the pawl 26 meshes with the tooth system 25 and prevents the ring disc 15 and thus the entire device gripping and clamping the core 13 from turning. The electromagnet or a pressure medium cylinder 27 is fixedly mounted on the stationary housing section 1. In place of a tooth system 25, another device can also be chosen that is in a position to prevent the clamping device from turning from time to time. This can be accomplished, for example, by means of a locking brake or replacing pawl 26 with a simple round pin which is plugged into a corresponding bore machined into the ring disc 15. Other means of preventing this turning will be readily apparent to one skilled in the art While the ring disc 15 is prevented from turning, the shaft 2 can be turned by introducing a corresponding moment of rotation against the brake comprising the coupling lining 20 and the coupling ring 21, or the forces generated by the brake. This turning can continue so long that the clamping segments 7 are moved to the outside radially in the direction of the arrow 12 due to the outer contour of the profile piece 11 so that the segments are in a position to grip and clamp securely the core 13 or one of the cores, sleeves or the like. On the other hand, the clamping segments 7 are prevented by the braking force from undesirably sliding back in the reverse direction of the arrow 12, i.e., radially towards the inside, with respect to the profile piece 11 by, for example, the vibrations of the machine. When clamping the core, overcoming the braking forces may appear at first astonishing. These braking forces are, however, small with respect to the moment of rotation which is available from the shaft 2 for winding the webs to be wound on the core 13. Such a high moment of rotation is already integrated into the machine due to the drive of the reels to be produced, yet was not required for the period of clamping the cores in prior machines. The present invention makes use of the moment of rotation that is already available for the process of clamping, with which process it is possible that, on the one hand, when the pawl 26 is forced in, the clamping process is automatic, i.e., in such a manner that human assistance for this process is no longer required, and that, on the other hand, the available drive moment is also used for the process of gripping and clamping the cores. The pawl 26 in turn is mounted on the housing section 1, the pivotable holding arm or the like so that the distance for locking into the accommodating device for the pawl 26 that is formed by the tooth system is optimally reduced to conserve space.

The pawl 26 can be released either by moving it in the direction of the arrow 28 relative to the housing section 1 or by a device that can pivot, for example, around a fixed pivot point and arranged correspondingly differently, out of the accommodating device for the pawl that is shown by the tooth system 25. As the occasion demands, several pawls 26 can also be distributed around the outside of the ring disc 15, i.e., since this part is designed circular, in the vicinity of the outer circumference of the ring disc 15. These multiple pawls can be engaged or disengaged by a single actuation, for example, with the aid of a push button or a remote control pulse.

Obviously, many further modifications and variations of the present invention are possible in light of the above teachings to one of ordinary skill in the art without departing from the spirit and scope of the invention as defined in the following claims.

I claim:

1. A device for releasably holding a core relative to a drive shaft passing therethrough, the holding device comprising:

at least two clamping elements located in the interior of the core;

means for displacing said clamping elements radially relative to the drive shaft;

means for guiding the displacement of said clamping elements;

a ring surrounding the drive shaft and fixedly connected thereto;

a ring disc surrounding the drive shaft, said ring disc being fixedly connected to said guiding means;

means for braking said ring relative to said ring disc; and means for releasably engaging said ring disc to prevent said ring disc from rotating.

2. The holding device according to claim 1, wherein said releasable engaging means comprises an engagement part which is received by a receiving portion in said ring disc and a means for displacing the engagement part into and out of the receiving portion.

3. The holding device according to claim 2, wherein the engagement part comprises a toothed pawl and the receiving portion comprises a similarly toothed portion.

4. The holding device according to claim 2, wherein the displacement means comprises an electromagnet.

5. The holding device according to claim 2, wherein the displacement means comprises a pressure medium cylinder.

6. The holding device according to claim 1, wherein said braking means is a friction brake.

7. The holding device according to claim 6, wherein the friction brake includes a friction lining located between said ring and said ring disc.

8. The holding device according the claim 7, wherein the friction lining is concentric about the drive shaft.

9. The holding device according to claim 6, wherein the friction brake comprises means for biasing said ring against said ring disc.

10. The holding device according to claim 9, wherein the biasing means comprises a spring.

11. The holding device according to claim 10, wherein the friction brake further comprises a friction lining between the pressure disc and said ring.

12. The holding device according to claim 9, wherein the friction brake further comprises a pressure disc located between the biasing means and said ring.

13. The holding device according to claim 1, wherein said releasable engaging means is fixed to a housing which supports the drive shaft.

* * * * *